United States Patent [19]

Sprenger

[11] 4,082,483

[45] Apr. 4, 1978

[54] OIL WELL PUMP

[76] Inventor: Alfred Paul Sprenger, 7630 N. 4th Ave., Phoenix, Ariz. 85021

[21] Appl. No.: 717,199

[22] Filed: Aug. 24, 1976

Related U.S. Application Data

[63] Continuation-in-part of Ser. No. 592,116, Jul. 1, 1975, abandoned.

[51] Int. Cl.[2] ..... E21B 27/00; F04B 21/04

[52] U.S. Cl. ..... 417/554; 294/69 R; 166/162

[58] Field of Search ..... 417/554, 545; 294/69; 166/162, 165, 167, 168

[56] References Cited

U.S. PATENT DOCUMENTS

| | | | |
|---|---|---|---|
| 686,951 | 11/1901 | Plotts | 166/165 |
| 1,875,174 | 8/1932 | McGivern | 294/69 R |
| 2,588,521 | 3/1952 | Hanline et al. | 166/165 |
| 2,925,866 | 2/1960 | Arterbury | 166/163 |

FOREIGN PATENT DOCUMENTS

| | | | |
|---|---|---|---|
| 24,938 | 3/1906 | Austria | 417/554 |
| 495,807 | 9/1953 | Canada | 417/488 |
| 192,102 | 11/1956 | Norway | 166/162 |

*Primary Examiner*—William L. Freeh
*Attorney, Agent, or Firm*—Warren F. B. Lindsley

[57] ABSTRACT

A novel oil well pump for reaching greater depths in wells than prior art structures having reduced down casing sizes wherein the pump comprises a plurality of individual hollow cylindrical chambers each operable in a given part of the pipe casing in conjunction with a pump plunger.

6 Claims, 2 Drawing Figures

OIL WELL PUMP

BACKGROUND OF THE INVENTION

This invention relates to an improved oil well pump for reaching greater depths in well casings having progressively reduced down casing sizes than the prior art pumps wherein the pump comprises a plurality of individual hollow cylindrical chambers each operable in given portions of the well casing and in conjunction with a common pump plunger.

DESCRIPTION OF THE PRIOR ART

Prior art pumps have a given plunger size for operating in each portion of a well casing regardless of its diameter. In well casings having casing portions reduced down in diameter from ground level to the bottom of the well, a given diameter plunger does not snugly fit in the casing and consequently does not pump the well effectively since a good share of the well's fluid slips past the plunger to the bottom of the well during a pumping stroke.

Those known pumps which have expandable rings wear extensively since they are required to expand over a number of well casing sizes and eventually lose their effectiveness.

SUMMARY OF THE INVENTION

In accordance with the invention claimed, a new and improved well pump is disclosed which comprises a plurality of cylindrical chambers each operable in a given portion of the well casing in conjunction with a common plunger. Each cylindrical chamber operates as an extension of the plunger and each extension will wipe and pump its respective well casing portion or section.

It is, therefore, one object of this invention to provide an improved fluid pump for operation in well casings having progressively reduced diameter portions or sections from the top to the bottom of the well casing.

Another object of this invention is to provide an improved fluid pump comprising two or more cylindrical chambers which operate in conjunction with a common plunger.

A further object of this invention is to provide an improved fluid pump for operation in a well casing having reduced diameter portions extending from the top to the bottom of the well wherein the plunger comprises a plurality of extensions of different diameters, each operable in a given portion of the well casing.

DESCRIPTION OF THE PREFERRED EMBODIMENT

Figure 1:
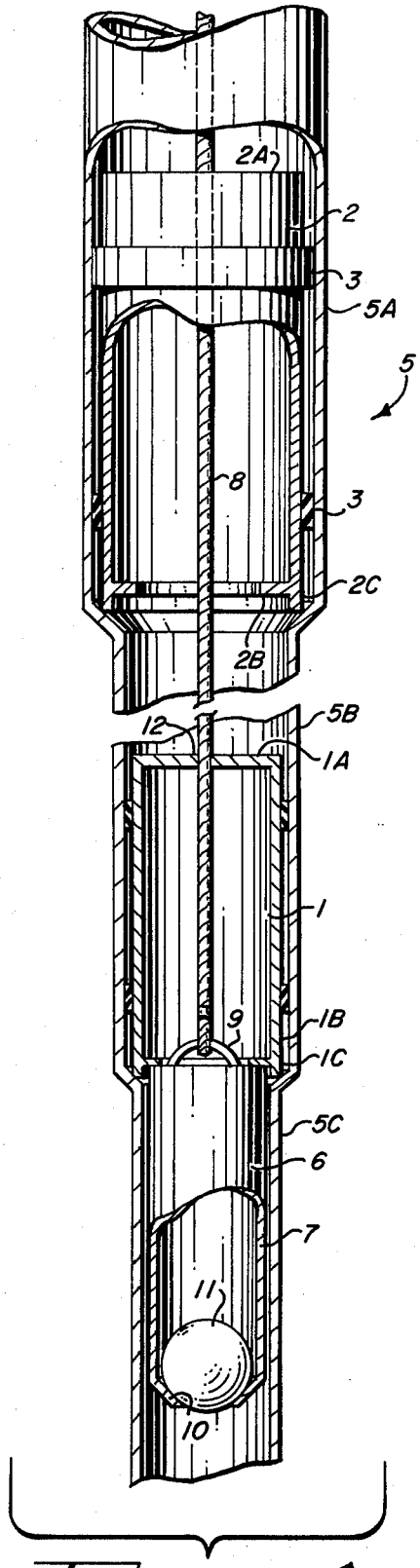
FIG. 1 discloses a well casing of progressively reduced diameter portions with the disclosed pump shown therein and embodying the invention.
Figure 2:
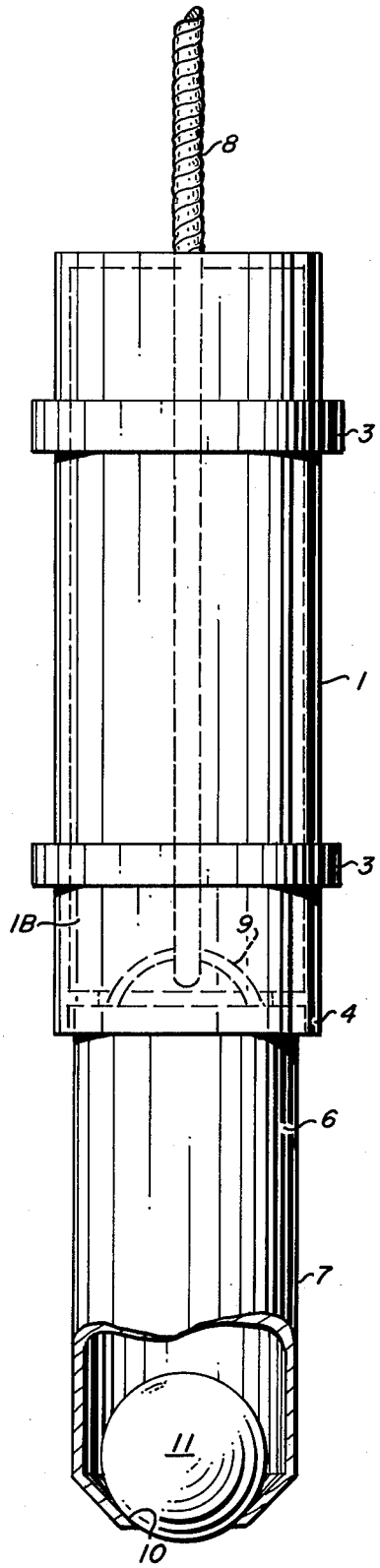
FIG. 2 is an enlarged portion of a part of FIG. 1.

Referring more particularly to the drawing by characters of reference, FIGS. 1 and 2 disclose a well casing 1 having positioned therein a fluid pump comprising for purposes of illustration a plunger employing three sections. One section comprises a hollow cylindrical plunger 6 of the type disclosed in copending application, Ser. No. 692,852 filed June 4, 1976 entitled OIL WELL PUMP hereinafter referred to and one or more cylindrical chambers or extensions 1 and 2 each operable in a portion of a well casing 5.

The well casing 5 comprises a plurality of casing sections which, for example, may comprise 5A, 5B and 5C each of a progressively smaller diameter than the next from the ground level to the bottom of the well interconnected in the usual manner. This type of well casing is particularly customary when well formations tend to crumble with drilling. Thus, short sections of the well are drilled and then cased, then further drilled down inside of the in place casing with a smaller drill bit.

The cylindrical plunger 6 comprises a hollow plunger housing or cylinder 7, the diameter and length of which may vary with the size of the lower sections of the well casing 5. The open ended cylinder 7 may be raised and lowered the entire distance of the well casing or less as desired by a steel cable 8 attached to strap or other suitable means 9 positioned across the upper end of cylinder 7 for raising and lowering it in the well casing during a pumping action.

The other end or bottom of the cylinder defines a valve seat 10 tapering outwardly of the housing in a funnel shaped manner.

As shown in the drawing, the plunger further comprises a ball 11 arranged in the hollow interior of the plunger for seating during upward movement of the plunger against the valve seat to retain in the plunger the fluid of the well.

The pump plunger 6 further comprises one or more extensions 1 and 2, one for each different diameter section of the well casing. These extensions comprise hollow cylinders closed at their upper ends 1 A and 2A, as shown, and open at their lower ends 1B and 2B. Each extension is of a diameter slightly smaller than the section of the well casing it is intended to pump and is provided with one or more slip rings 3 which may be rubber detachably mounted around the outside periphery of the extension, as shown in the drawing. Each ring may be provided with screw lock joints (not shown) to provide for placement and removal of the rings from around the outside periphery of the extension.

The lower or open end of each extension is provided with a lip sealing surface 1C and 2C which are provided for engaging and detachably sealing with the juxtapositioned lower extension of plunger. FIGS. 1 and 2 illustrate the engagement of lip 1 C of extension 1 with the outer peripheral surface of the top of the plunger.

OPERATION

When the plunger is dropped to the bottom of the well casing by unwinding cable 8 from a drum (not shown), each extension, such as extensions 1 and 2 of the pump plunger combination, drops by gravity through the well fluid and comes to rest on the top of well casing of a diameter less than its diameter, as shown in the drawing.

Each associated lower well casing then holds the extension in the upper well casing section until the plunger 6 on its upward movement or pumping stroke picks it up and moves it toward the top of the well, i.e., the plunger 6 moves into engagement with the lips 1C at the lower end 1B of extension 1 and then moves in unison with extension 1 upwardly in the well casing until the upper end 1A of extension 1 engages the lips 2C of the lower end 2B of extension 2 and then the plunger 6 and extensions 1 and 2 move in unison toward the top of the well casing. If the pump comprises more than two extensions, each extension in the other well casing sections are joined and move in unison in the manner described for the assembly of sections 1 and 2 with plunger 6 in its upward movement during a pumping action.

The extensions will each wipe and pump the walls of the chamber of their associated well casing in conjunction with the pump plunger 6 and continue this pumping action all the way to the top of the well casing. It should be noted that the fluid in each extension is captured within it and the outer periphery of the casing pushes the well fluid above it as it moves upwardly in the well into the open end of the extension above it in a different well casing section and seals it in the adjacent extension by the sealing engagement of its top surface with the lips of the open end of the extension above it.

For excessively deep wells, it may be necessary to relieve the weight of the fluid in the pump assembly by specially designed top pumping sections.

After the pump has delivered its fluid upstroke, the plunger with cable 8 sliding through bearings 12 in the center of the extensions drops back to the bottom of the well casing to be in position for another pumping action upstroke.

Although but one embodiment of the invention has been shown and described, it will be apparent to those skilled in the art that various changes and modifications may be made therein without departing from the spririt of the invention or from the scope of the appended claims.

What is claimed is:

1. A pump for operation in a well casing comprising:

a plunger, a first plunger extension, said plunger comprising an open ended hollow cylinder, one end of said cylinder being provided for attaching to a cable, the other end of said cylinder being provided with a valve seat interiorally thereof, a ball captured within said cylinder for movement longitudinally thereof for seating in said valve seat during movement of said cylinder in one direction in a well casing for closing said other end of said cylinder, said extension comprising a hollow cylindrical member mountable in a well casing at a level above said plunger and substantially closed at its upper ground level end of the well casing and open at its other end, said closed end provided with a cable bearing aperture for receiving the cable passing from said plunger through its hollow interior and bearing aperture on the way to the top of the well casing, and a second extension similar to said first extension but of a larger diameter than said first plunger extension and operable in a section of the well casing of a larger diameter than the section of the well casing operated in by said first extension, whereby movement of said plunger toward the ground surface end of the well casing causes the upstream end of said plunger to frictionally engage the downstream end of said first extension and to move in unison with said first extension upwardly in the well casing until the closed end of said first extension frictionally engages the open end of said second extension capturing fluid within its hollow interior and to then move in unison with said first and second extensions upwardly toward the ground level in the well casing.

2. The pump set forth in claim 1 wherein:

each of the extensions are provided with a slip ring arranged around its outer periphery for engaging the walls of a portion of the well casing in a wiping manner as it moves therethrough.

3. The pump set forth in claim 1 wherein:

the open end of one of the extensions is provided with lips for detachable sealing engagement with the upstream end of said plunger.

4. The pump set forth in claim 1 wherein:

each of the extensions are provided with a larger diameter than said plunger and operable in the well casing in a section of a larger diameter nearer ground level than a lower section into which said plunger is moved by gravity.

5. The pump set forth in claim 1 wherein:

said first and second extensions are each provided with slip rings arranged around their outer peripheries for engaging the walls of different sections of the well casing in a wiping manner as it moves therethrough.

6. The pump set forth in claim 1 wherein:

the open end of said second extension is provided with lips for detachable sealing engagement with the closed end of said first extension.

* * * * *